US006026907A

United States Patent [19]

Pahila

[11] Patent Number: 6,026,907

[45] Date of Patent: Feb. 22, 2000

[54] FAST RESPONSE RESIDENTIAL SPRINKLER ARRANGEMENT

[75] Inventor: Oliver S. Pahila, Mount Vernon, N.Y.

[73] Assignee: The Reliable Automatic Sprinkler, Co. Inc., Mount Vernon, N.Y.

[21] Appl. No.: 09/206,859

[22] Filed: Dec. 8, 1998

[51] Int. Cl.[7] ..... A62C 37/08; B05B 1/26

[52] U.S. Cl. ..... 169/37; 239/498; 239/524

[58] Field of Search ..... 239/498, 520, 239/524, 518; 169/37, 41, 57

[56] References Cited

U.S. PATENT DOCUMENTS

| | | | |
|---|---|---|---|
| 2,135,138 | 11/1938 | Kendall . | |
| 2,697,008 | 12/1954 | Rowley | 239/498 |
| 3,874,455 | 4/1975 | Klesow . | |
| 4,296,815 | 10/1981 | Mears | 239/498 X |
| 4,580,729 | 4/1986 | Pounder | 239/524 |
| 5,152,344 | 10/1992 | Fischer et al. . | |
| 5,366,022 | 11/1994 | Meyer et al. | 169/37 |
| 5,687,914 | 11/1997 | Bosio et al. . | |
| 5,839,667 | 11/1998 | Fishcer | 239/498 |
| 5,890,657 | 4/1999 | Ponte | 169/37 X |

*Primary Examiner*—Kevin Weldon
*Attorney, Agent, or Firm*—Baker & Botts, LLP

[57] ABSTRACT

In a particular embodiment disclosed in the specification a sprinkler has a sprinkler body with a passage having an orifice which is normally closed by a cap retained in position by a glass bulb thermally responsive element and a deflector spaced from the orifice and supported from the sprinkler body by a pair of arms. The deflector has a circumferential array of tines separated by openings and the openings located in the plane in the frame arms have a substantially teardrop shape with the larger end closer to the sprinkler axis having a width which is 120% to 160% of the width of the adjacent portions of the frame arms.

7 Claims, 2 Drawing Sheets

FAST RESPONSE RESIDENTIAL SPRINKLER ARRANGEMENT

BACKGROUND OF THE INVENTION

This invention relates to sprinkler arrangements and more particularly to fast response residential sprinkler arrangements.

The National Fire Protection Association standards NFPA 13D and 13R for residential sprinklers specify minimum flow rates of 9 gallons per minute at a pressure of 9 psi for single sprinklers having a maximum spacing of 6 feet from a wall and 10 gallons per minute at a pressure of 11.1 psi for single sprinklers having a maximum distance of 7 feet or 8 feet from a wall. For two or more sprinklers in the same room having 12, 14 or 16 foot spacings, the minimum required flow rate is 8 gallons per minute at a pressure of 7.1 psi. In order to provide the necessary protection, the distribution of water along the adjacent walls and over the floor area beneath the sprinklers should be substantially uniform.

Various sprinkler arrangements and deflector designs have been proposed heretofore to provide desired water flow rate distribution patterns. For example, the Bosio et al. U.S. Pat. No. 5,687,914 discloses a sprinkler arrangement having a deflector supported from a pair of frame arms which has enlarged tines in the plane of the frame arms with their inner ends bent away from the frame arms and their outer ends inclined slightly toward the frame arms. The Grinnell Model F680 sprinkler has a planar deflector with keyhole-shaped slots distributed around the periphery with the circular part of the keyhole for slots in the plane of the frame arms having a diameter smaller than that of the other slots. Those arrangements, however, do not provide the desired water distribution uniformity for flow rates and pressures of the type mentioned above for residential sprinklers.

SUMMARY OF THE INVENTION

Accordingly, it is an object of the present invention to provide a residential sprinkler arrangement which overcomes disadvantages of the prior art.

Another object of the invention is to provide a fast response residential sprinkler arrangement providing highly uniform water distribution at the minimum required flow rates and pressures.

These and other objects of the invention are attained by providing a sprinkler having a sprinkler body with a passage having an orifice which is normally closed by a cap retained in position by a thermally responsive element and a deflector spaced from the orifice and supported from the sprinkler body by a pair of arms and disposed generally in a plane perpendicular to the axis of the passage in which the deflector has a central portion and a peripheral portion with a circumferential array of tines separated by openings including openings located in the plane of the frame arms having a substantially teardrop shape with the larger end closer to the sprinkler axis with the adjacent tine edges tapering inwardly in the direction toward the periphery of the deflector. As used herein, the term "substantially teardrop" or "generally teardrop shaped" means deflector openings which are relatively wide at an inner end closer to the sprinkler axis and relatively narrow at an outer end closer to the deflector periphery and which have sides that taper inwardly from the wide region toward the narrow region.

Preferably the tines adjacent to the teardrop shaped openings have an outer portion which is displaced out of the plane of the deflector in the direction away from the body of the sprinkler with the outer end inclined slightly toward the sprinkler body. In a preferred embodiment, the portions of the deflector on opposite sides of the plane of the frame arms each have six slot-like openings formed between adjacent tines and two openings closest to the plane of the frame arms on each side extend inwardly from the periphery of the deflector to a greater extent than the other slot-like openings while two openings adjacent to the longer openings are shorter than all of the other openings. In order to provide a fast response, the sprinkler preferably has a thermally responsive device in the form of a glass bulb which normally retains the cap in position in the orifice and is designed to release the cap at a relatively low temperature such as about 155° F.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
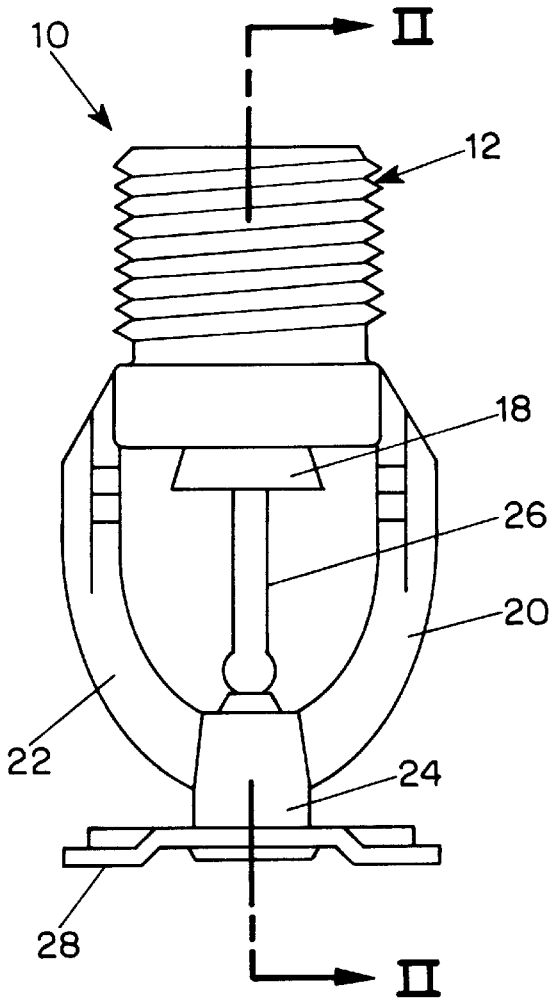
FIG. 1 is a side view illustrating a representative embodiment of a sprinkler arrangement according to the invention.
Figure 2:
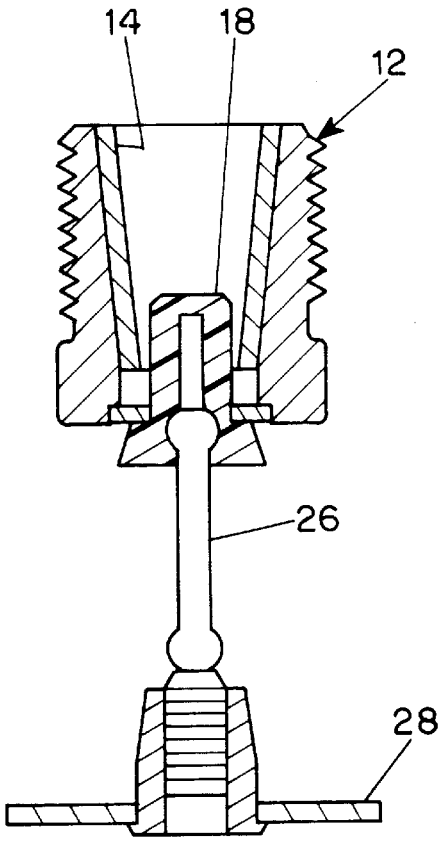
FIG. 2 is a longitudinal sectional view of the sprinkler arrangement shown in FIG. 1, taken on the line II—II therein and looking in the direction of the arrows.

In the typical embodiment of the invention shown in the drawings, a sprinkler arrangement 10 has a threaded body 12 adapted to be connected to a water supply pipe with an axial passage 14 terminating in an orifice 16 which is normally closed by a cap 18. The sprinkler body 12 has a pair of frame arms 20 and 22 extending away from the orifice 16 in the plane of the sprinkler axis and terminating in a boss 24. To normally retain the cap in its sealing position in the orifice 16 preventing water in the passage 14 from being released a thermally responsive element 26 is positioned between the boss 24 and the cap 18.

Figure 3:
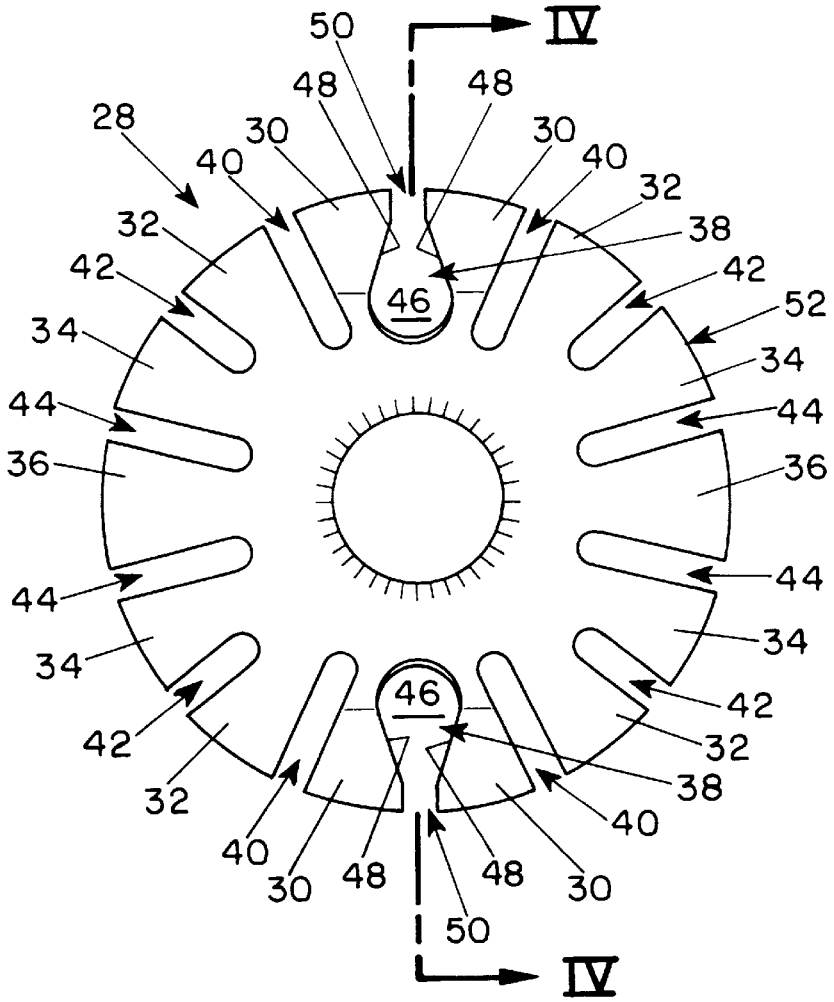
FIG. 3 is an end view illustrating the deflector used in the embodiment shown in FIGS. 1 and 2.

In order to provide a fast response, the thermally responsive element 26 is preferably a glass bulb which is set to break when heated to a temperature of about 155° F., permitting pressurized water in the passage 14 to force the cap 18 out of the orifice 16 and release a stream of water through the orifice to distribute the water passing through the orifice over an area to be protected, a deflector 28 is mounted on the boss 24 in a plane perpendicular to the axis of the passage 14 and, to produce a desired uniform distribution of water over the area to be protected, the deflector 28 is formed with a fourteen peripheral tines 30, 32, 34 and 36, separated by fourteen radially extending openings, 38, 40, 42 and 44, as shown in FIG. 3, identical tines and identical openings being designated by the same reference numeral. The openings 38 which are formed between the adjacent tines 30 and extend in the plane of the frame arms 20 and 22 have a generally teardrop shape with a large end portion 46 closest to the axis of the sprinkler and inwardly inclined sides 48 extending toward a smaller end portion 50 having parallel sides near the periphery 52 of the deflector. In the illustrated embodiment the sides 48 are inclined inwardly at a substantially constant angle but the angle of inclination may vary along the length of the sides 48. The four openings 40 which are on opposite sides of the generally teardrop shaped openings 38 are slot-like openings having parallel sides and they extend inwardly from the periphery 52 to the same extent as the generally teardrop shaped openings 38.

To provide the desired uniformity of water distribution in the plane of the frame arms 20 and 22, the width of the largest part 46 of the generally teardrop shaped openings 38 is preferably in the range of about 120% to 160%, and desirably about 130% to 140%, of the thickness of the frame arms 20 and 22 in the direction perpendicular to the plane of the frame arms in the region adjacent to the boss 24. In a preferred embodiment the largest part 46 of the openings 38 has a maximum width of about 0.16 inch (4.1 mm) and the frame arms 20 and 22 have a thickness of about 0.12 inch (3.0 mm) in the direction perpendicular to the plane of the frame arms in the region adjacent to the boss 24. In this embodiment, the deflector 28 has a thickness of about 0.05 inch (1.27 mm) and a diameter of about 1.18 inch (30.0 mm) and the generally teardrop shaped openings 38 extend inwardly about 0.28 inch (7.1 mm) from the periphery with the inwardly tapering sides 48 terminating in a region 50 having parallel sides spaced by about 0.07 inch (1.78 mm) for a distance of about 0.055 inch (1.4 mm) from the periphery 52 of the deflector.

Figure 4:
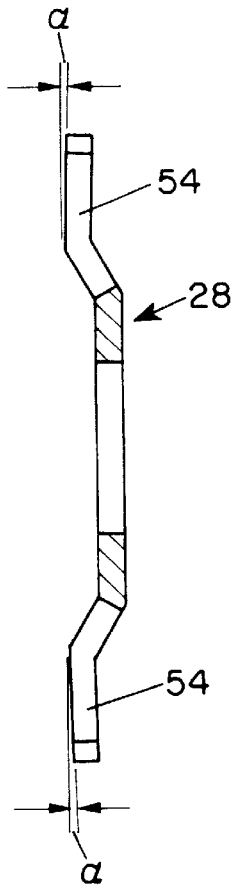
FIG. 4 is a cross-sectional view taken along the lines IV—IV of FIG. 3.
Figure 5:
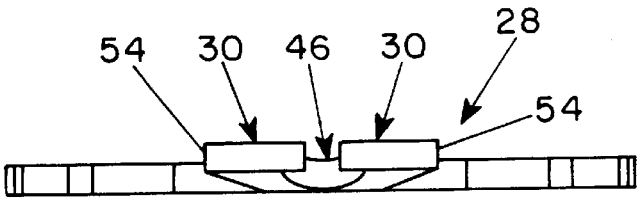
FIG. 5 is an edge view of the deflector shown in FIG. 3.

In this embodiment each of the slots 40, 42 and 44 has a width of about 0.062 inch (1.57 mm) while the slots 40 have a length of about 0.28 inch (7.1 mm), the slots 42 have a length of about 0.19 inch (4.83 mm), and the slots 44 have a length of about 0.27 inch (6.9 mm). In addition, the tines 30 on opposite sides of each of the generally teardrop shaped openings 38 are formed with end sections 54 which are displaced away from the plane of the deflector 28 by providing two bent portions 56 and 58 as shown in FIGS. 4 and 5. These end sections 54 are spaced from the plane of the deflector by about 0.05 inch and they are slightly inclined toward the sprinkler body at a small angle such as 1° to 3° and preferably about 1.5° as shown in FIG. 4.

Although the invention has been described herein with reference to specific embodiments, many modifications and variations therein will readily occur to those skilled in the art. Accordingly, all such variations and modifications are included within the intended scope of the invention.

I claim:

1. A residential sprinkler arrangement comprising:

a sprinkler body having an axial passage for delivery of fire extinguishing fluid;

a pair of arms extending from the sprinkler body in a plane generally parallel to the sprinkler axis;

a deflector supported by the pair of arms and disposed generally in a plane perpendicular to the axis of the sprinkler body and having a central portion and a peripheral array of tines separated by radially extending openings;

the radially extending openings including two teardrop shaped openings disposed in the plane of the frame arms on opposite sides of the sprinkler axis and having edges which are inclined inwardly toward each other in the direction toward the periphery of the deflector.

2. A residential sprinkler arrangement according to claim 1 wherein each of the teardrop shaped openings is formed by adjacent tines having portions which are displaced from the plane of the deflector in the direction away from the sprinkler body.

3. A residential sprinkler arrangement according to claim 2 wherein the displaced tine portions are inclined toward the sprinkler body at an angle in the range of about 1° to 3°.

4. A residential sprinkler according to claim 3 wherein the displaced tine portions are inclined toward the sprinkler body at an angle of about 1.5°.

5. A residential sprinkler according to claim 1 wherein the generally teardrop shaped openings have a maximum width in the region closest to the sprinkler axis which is in the range from about 120% to 160% of the thickness of the frame arms in the direction perpendicular to the plane of the frame arms in a region adjacent to the deflector.

6. A residential sprinkler according to claim 5 wherein the maximum width in the region closest to the sprinkler axis is in the range from about 130% to 140% of the thickness of the frame arms in a region adjacent to the deflector.

7. A residential sprinkler arrangement according to claim 1 wherein the teardrop shaped openings have edges which are inclined toward each other at a substantially constant angle in the direction toward the periphery of the deflector.

* * * * *